United States Patent [19]

Mori et al.

[11] Patent Number: 4,534,665

[45] Date of Patent: Aug. 13, 1985

[54] SERIAL PRINTER

[75] Inventors: Masahiko Mori; Kenichiro Arai; Chikao Tezuka, all of Shiojiri, Japan

[73] Assignees: Epson Corporation; Kabushiki Kaisha Suwa Seikosha, both of Japan

[21] Appl. No.: 468,625

[22] Filed: Feb. 22, 1983

[30] Foreign Application Priority Data

Feb. 22, 1982 [JP] Japan ..... 57-26979
Feb. 22, 1982 [JP] Japan ..... 57-26980

[51] Int. Cl.[3] ..... B41J 1/50

[52] U.S. Cl. ..... 400/145.2; 400/187; 400/140; 101/93.17; 101/93.18; 101/93.21

[58] Field of Search ..... 400/140, 141, 141.1, 400/142, 145, 145.1, 145.2, 147, 148, 152, 154, 154.1, 185, 187; 101/93.14, 93.15, 93.16, 93.17, 93.18, 93.21, 93.26; 178/28, 29, 34, 35, 38

[56] References Cited

U.S. PATENT DOCUMENTS 3,326,346 6/1967 Sasaki ..... 400/141.1
4,244,291 1/1981 Kodaira et al. ..... 101/93.17
4,352,576 10/1982 Hori et al. ..... 101/93.17
4,414,893 11/1983 Hori et al. ..... 101/93.15
4,426,167 1/1984 Iwane ..... 101/93.17
4,437,777 3/1984 Hori ..... 101/93.16

FOREIGN PATENT DOCUMENTS 57-25965 2/1982 Japan ..... 400/145.2

*Primary Examiner*—Edgar S. Burr
*Assistant Examiner*—David A. Wiecking
*Attorney, Agent, or Firm*—Blum Kaplan Friedman Silberman & Beran

[57] ABSTRACT

A multicolor serial printer has a color switching means interposed between an end of a carriage and type wheels having a group of first-color printing types and a group of second-color printing types. The color switching means has first-color and second color printing stepped surfaces selectively movable into confronting relationship with a member of the carriage. When the member of the carriage abuts on and engages in a first-color printing stepped surface or a second-color printing stepped surface during carriage shifting movement, a presser of a hammer means, mounted on the carriage and positioned within the type wheels, is brought into confronting relation to the group of first-color printing types or the group of second-color printing types for printing a desired character in the group in a first or second color.

12 Claims, 15 Drawing Figures

23
23a
23b
23c
23d
23e
23f
23f-1
23g
26
8q-1
C
16
16b
16c
16d
16e
16f
16g
16h
16j
16k
16l
16g-T
16f-T
T1
T2
T3
T4
T5
T6
T7
T8
T9
T10
T11
T12
T13
T14
TP

SERIAL PRINTER

BACKGROUND OF THE INVENTION

This invention relates generally to a small-size type-printing serial printer and more particularly to a printer capable of multicolor printing operation. Known serial printers capable of two-color printing operation include large-size daisy wheel printers, badminton printers, ball printers and the like using two-color ink ribbons. Small-size printers for use on electronic desktop calculators are available in limited types. One known such small-sized printer is a serial printer construction proposed in Japanese Laid-Open Patent Publication No. 56-28885, which is capable of only single-color printing. This type of serial printer comprises two type wheels each supporting a series of type around its outer peripheral edge and movable at incremental steps along a guide shaft to print character by character across the sheet. In a standby position, one of the two type wheels for printing characters in a first color is located in a lowest character or digit position, and the other type wheel for printing characters in a second color is located in a highest character or digit position. For printing characters in the first color, the first-color printing type wheel is shifted from the lowest character position successively toward the highest character position. Conversely, for printing characters in the second color, the second-color printing type wheel is shifted from the highest character position successively toward the lowest character position.

Where a printer of the above type is incorporated in an electronic desktop calculator, the number of digits usually appearing in the printer across the line is far smaller than the maximum number of digits that can be printed. When characters are to be printed in the first color, the first-color printing type wheel moves stepwise from the standby or lowest character position until all necessary digits are printed, whereupon the type wheel returns to the standby position. Therefore, the first-color printing type wheel can print characters speedily. For printing digits in the second color, however, the second-color printing type wheel has to traverse a blank space from the standby or highest character position before it can print necessary digits down to the lowest character position. Therefore, the second-color printing type wheel is required to move across all of the digit positions before it returns to its standby position, a disadvantage which greatly reduces the printing speed. The operator who uses a calculator incorporating this type of printer tends to become irritated because of the slow printing speed. Furthermore, the prior art printer is unable to effect multicolor printing operation using three different colors or more.

What is needed is a serial printer capable of printing in a plurality of colors with a speed substantially equal to that of a monochrome serial printer.

The present invention has been made in view of the above prior art difficulties.

SUMMARY OF THE INVENTION

Generally speaking, in accordance with the invention, a serial printer especially suitable for printing in at least two colors is provided. The printer comprises a plurality of print wheels of flexible material in the form of annular rings. Each print wheel includes a plurality of raised type positioned on and spaced around the outer peripheral surface of the annular ring. A cage-like structure holds the print wheels permitting access to the backside of each raised type on every print wheel. A hammer extends within the print wheel support structure and is indexable so that it can selectively strike different ones of the print wheels.

The hammer, print wheels and their supporting structure are mounted on a translatable carriage, and the print wheels are rotatable so that any particular type on each wheel may be selected for impact against a platen. Impact results when the hammer strikes the backside of the selected type and extends the flexible print wheel so as to press the face of the selected type against the platen. Switching means are provided to index the hammer relative to the print wheels at a selected columnar print position permitting printing with one color ink at each position up to the selected columnar position, and therefore printing the remainder of the line in a second selectable color.

Having the different color print wheels mounted adjacent to each other and moving together at all times, and indexing the hammer allows printing in a plurality of colors with substantially the same rapidity as printing in one color with a serial printer.

Accordingly, it is an object of the present invention to provide an improved two-color type-printing serial printer capable of printing characters in first and second colors substantially at the same speed as a single color printer especially where identical characters are to be printed in each case in identical numbers of characters positions.

Another object of the invention is to provide an improved serial printer which prints symbol characters in different color from the numeric characters.

Still another object of the invention is to provide an improved serial printer having a selection of colors in which characters can be printed.

Still other objects and advantages of the invention will in part be obvious and will in part be apparent from the specification.

The invention accordingly comprises the features of construction, combination of elements, and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

An embodiment of the present invention will now be described with reference to FIGS. 1 through 6 and 8.

Figure 1:
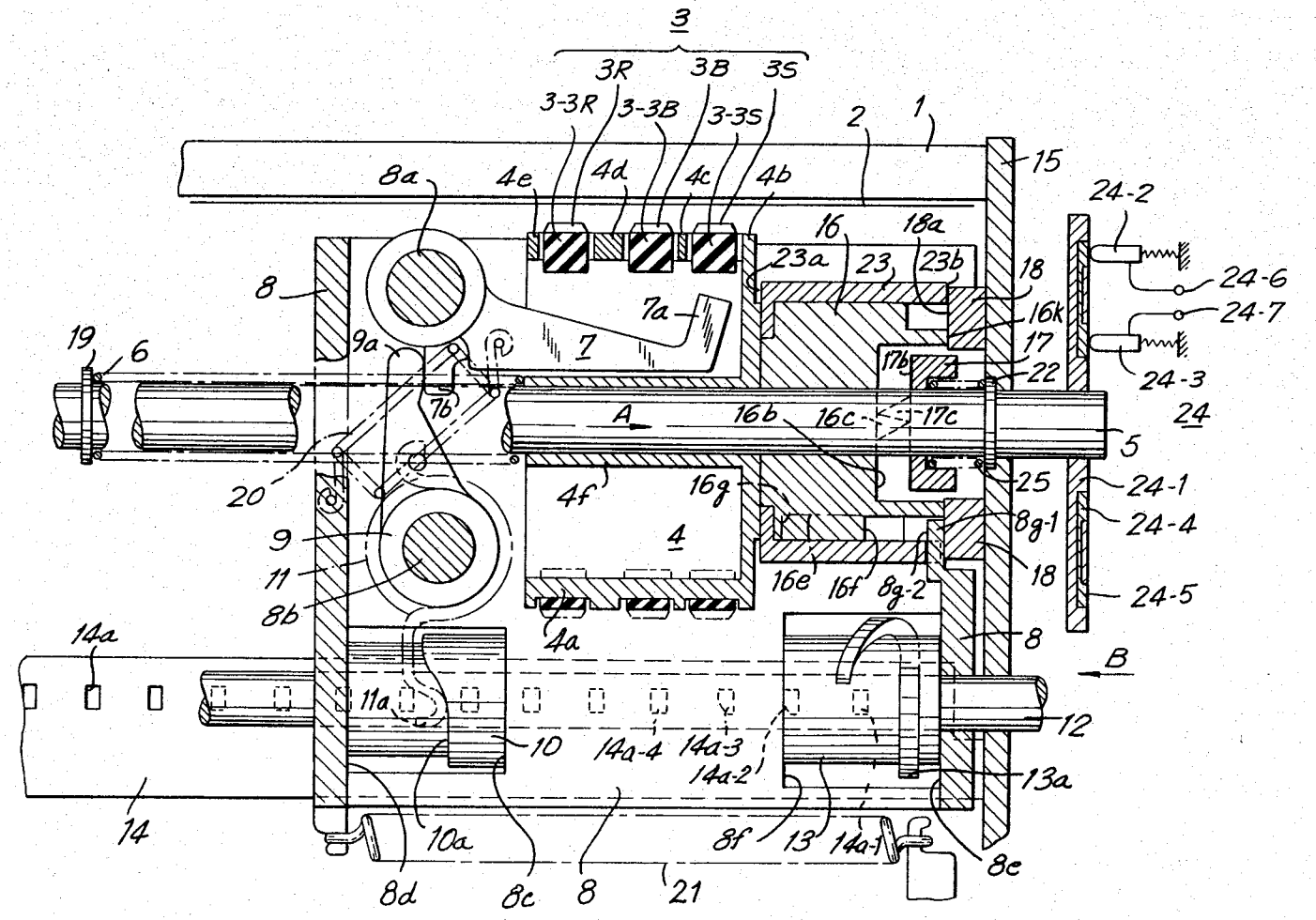
FIGS. 1, 4, 5 and 6 are top sectional views with portions omitted of a serial printer in accordance with the invention, showing different positions in a sequence of operations.
Figure 2:
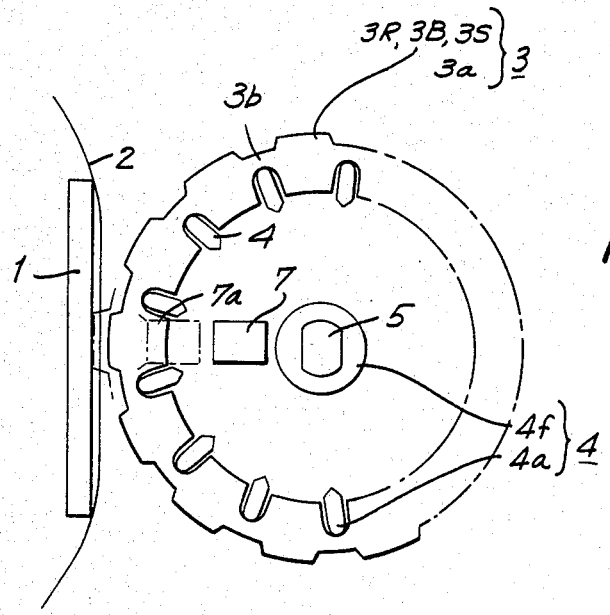
FIG. 2 is a sectional side view of a type wheel, holder and hammer in the serial printer of FIG. 1.
Figure 10:
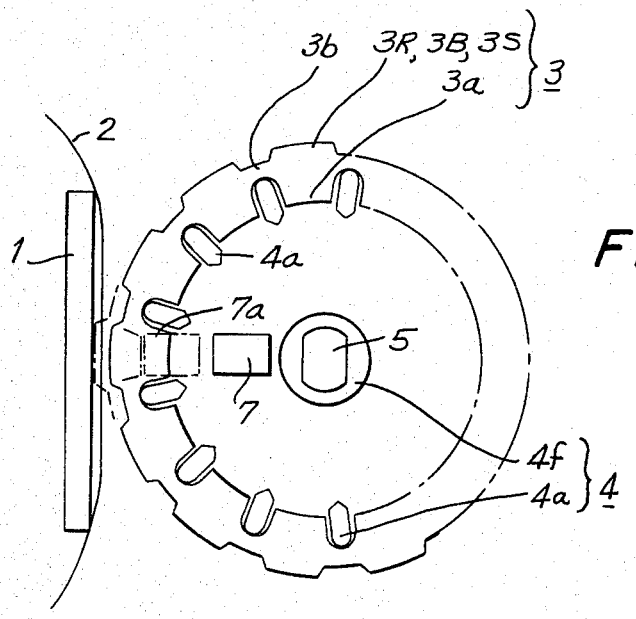
FIG. 10 is a side sectional view of a type wheel, a holder and a hammer in the serial printer of FIG. 9.

FIG. 1 is a plan view, partly in cross-section, of a serial printer according to the present invention, with portions being omitted for an easier understanding of the present invention. A sheet of paper 2 on which characters are to be printed is supplied by a paper feed roller and a paper guide (not shown) along a platen 1 in front of type wheels 3 of rubber. Each of the type wheels 3 is in the form of a ring supporting on its periphery fourteen types 3R, 3B or 3S, that is, raised alpha-numeric characters or symbols, as shown in FIG. 2 which is a transverse sectional view of the type wheel 3.

The types have radial inner bases 3*a* positioned around the periphery of a holder 4 of the type wheel 3. In particular, as is apparent from FIGS. 1 and 2, the holder 4 is substantially in the form of a cage comprising fourteen axial ribs 4*a*, circumferential ribs 4*c*, 4*d*, 4*e*, and a flange 4*b*. The spaced ribs 4*a* extending from the periphery of the flange 4*b*, and the ribs 4*e* extending circumferentially and transversely to the ribs 4*a* form a holding cage and jointly define forty-two holes of substantially square shape on the generally cylindrical outer surface of the holder 4. The type wheel 3 is supported in place with the type bases 3*a* being held respectively in holes in the holder 4.

Figure 8:
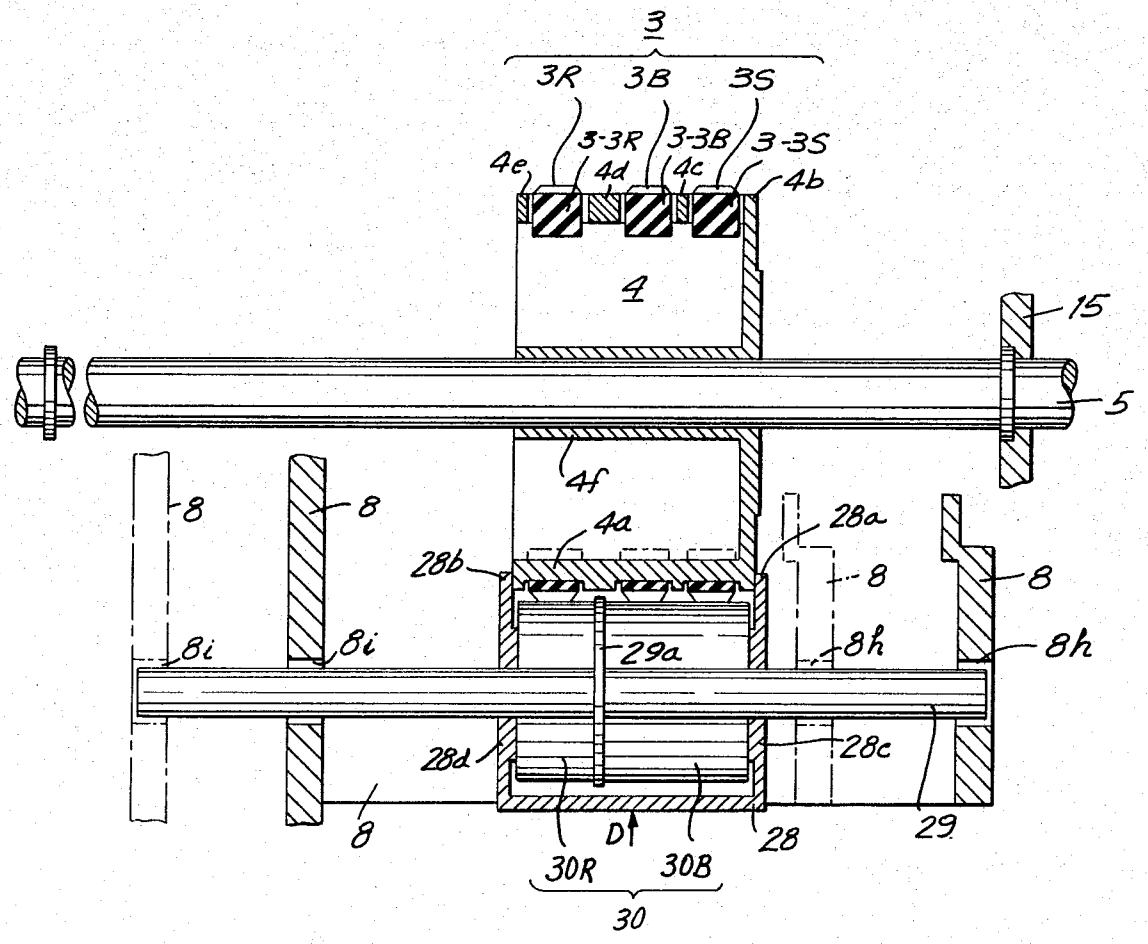
FIG. 8 is a top sectional view with parts omitted of an ink supply system in the serial printer of FIG. 1.

The holder 4 has a central boss 4*f* fitted over a rotatable shaft 5 of cylindrical cross-section, with two opposite flat faces for axial slidable movement therealong and angular movement therewith about the shaft axis. The boss 4*f* has a lefthand end (FIG. 1) urged by an urging means such as a compression coil spring 6 in the direction of the arrow A. The compression coil spring 6 has one end supported on a spring seat 19 disposed for rotation with the rotatable shaft 5. A hammer 7 has a presser 7*a* movable to push a selected one of the type bases 3*a* toward the platen 1 as shown by the two-dot-and-dash lines in FIG. 2 for thereby pressing the type 3R, 3B or 3S against the sheet 2 to transfer ink from the type surfaces onto the sheet 2. FIG. 8 illustrates an ink roll 30 serving as a means for supplying ink to the type surfaces, the ink roll 30 being held in rolling contact with the type surfaces at all times. The ink roll 30 will be described later herein in more detail.

The hammer 7 is pivotably supported on a shaft 8*a* mounted on and projecting from a carriage 8, movable axially of the rotatable shaft 5 and independently of the holder 4 within a certain range. The shaft 8*a* serves as part of the means for determining the path of movement of the presser 7*a*. The hammer 7 includes an arm 7*b* drivable by an arm end 9*a* of a hammer driving lever 9 so as to turn counterclockwise in FIG. 1 about the shaft 8*a*. The hammer driving lever 9 is pivotably supported on a shaft 8*b* mounted on and extending from the carriage 8. A torsion coil spring 11 is disposed on the hammer driving lever 9, and has one end secured thereto and the other end acting as a follower 11*a* held against a concave cam surface 10*a* of a hammer driving cam 10.

The hammer driving cam 10 is sandwiched between end faces 8*c*, 8*d* of a hole extending axially of, that is, parallel to the rotatable shaft 5 in the carriage 8. The driving cam 10 is fitted over a driver shaft 12 having a cross-sectional shape substantially similar to that of the rotatable shaft 5, for axial slidable movement therealong and angular movement therewith about its axis.

In a printing operation, the driver shaft 12 rotates counterclockwise about an axis thereof, as seen in the direction of the arrow B, to cause the hammer driving cam 10 to turn counterclockwise. At this time, the follower 11*a* on the torsion coil spring 11 is moved substantially in the direction of the arrow B at first, turning the hammer driving lever 9 clockwise to cause the arm end 9*a* thereof to push the arm 7 of the hammer 7 substantially in the direction of the arrow A. The hammer 7 is then turned counterclockwise or the shaft 8*a* causing the presser 7*a* thereof to push the type base 3*a* toward the platen 1.

When the follower 11*a* of the torsion coil spring 11 slides over the crest of the concave cam surface 10*a* and moves in a direction opposite to the direction of the arrow B during a hammer return stroke, the hammer driving lever 9 and the hammer 7 move in directions opposite to those described above. To return the hammer 7 in a reduced interval of time, the hammer 7 is biased by a tension coil spring 20 having one end engaging the hammer 7 and the other end retained on the carriage 8.

The serial printer according to the present invention is required to print characters while being shifted in increments from the lowest character position (at the right in FIG. 1) in the direction of the arrow B. Such successive shifting movement of the carriage 8 is effected as follows: A cylindrical shifting cam 13 is sandwiched between opposite end faces 8*e*, 8*f* of a hole defined in the carriage 8 and fitted over the driver shaft 12 for axial slidable movement therealong and angular movement therewith about its axis. The shifting cam 13 has a ridge 13*a* extending around its periphery and having a lead, that is, the ridge is not a circular ring but extends in part to the left FIG. 1 along the cam surface. During each carriage shifting stroke, the ridge 13*a* engages one of a plurality of teeth 14*a* mounted at a predetermined pitch distance on a positioning plate 14 and arranged in the axial direction of the driver shaft 12 and adjacent to the ridge 13*a*.

Each time the driver shaft 12 makes one revolution, the carriage shifting cam 13 and hence the carriage 8 are shifted together by a pitch distance corresponding to an interval between two adjacent teeth 14*a*. The hammer driving cam 10 and the carriage shifting cam 13 which are rotatable with the driving shaft 12 are angularly position with respect to each other to complete a single character printing operation and a single carriage shifting movement while the driver shaft 12 makes one revolution. More specifically, the 360° angle through which the driver shaft 12 is rotatable about its own axis to make one revolution is divided into two angular intervals. In the one of these two angular intervals in which the hammer 7 prints a character, the ridge 13*a* of the carriage shifting cam 13 does not produce a lead so that the carriage 8 is not shifted in the axial direction of the driver shaft 12. After a character has been printed by the hammer 7, the position of the ridge 13*a* which produces the lead engages one of the teeth 14*a* to displace the carriage 8 by one increment along the driver shaft 12.

When the carriage 8 is to be returned to its standby position (rightward in FIG. 1) after it has been shifted to a final character position and all necessary characters have been printed across the line, the positioning plate 14 is forcibly displaced out of engagement with the ridge 13*a*. The carriage 8 then returns to the starting position under the urging of a tension coil spring 21 extended between a portion of the carriage 8 and a fixed member such as a frame 15. The spring 21 is extended as character printing progresses along each line.

A mechanism for printing characters in two colors according to a principal feature of the present invention will now be described. The serial printer according to the present invention is designed for the use on an electronic desktop printer and is arranged to start printing characters from the lowest character position on the sheet 2 (at the right in FIG. 1). In FIG. 1, the carriage 8 and the type wheel 3 are urged to a righthand standby position under the force of the tension coil spring 21 and the compression coil spring 6, respectively. A first cam 16 is disposed between the flange 4*b* of the holder 4 and the frame 15, with an end face 16*k* held against a carriage stopper 18. The first cam 16 is fitted over the rotatable shaft 5 for axial slidable movement therealong and rotatable movement therearound. A second cam 17 is axially and slidably fitted over the rotatable shaft 5 and is normally urged toward the first cam 16 by urging means such as a compression coil spring 25 having one end seated on a flange 22 on the rotatable shaft 5. The second cam 17 is rotatable with the rotatable shaft 5 about its axis.

The carriage stopper 18 is fixed to the frame 15 and engageable with a portion 8*g*-1 of the carriage 8. A third cam 23 which serves as part of a trigger means, is journalled around the outer circumferential surface of the first clutch means 16, and has one end face 23*a* bearing on the flange 4*b* of the holder 4 and the other end face 23*b* facing a surface 18*a* of the carriage stopper 18 with a slight clearance therebetween. The first and second cam 16, 17 have opposite annular surfaces 16*b*, 17*b*, respectively, having thereon at least a pair of teeth 16*c*, 17*c* of substantially triangular cross-section, respectively, engageable with each other when the first and second cam 16, 17 rotate about the rotatable shaft 5.

For a better understanding of the configurations of the first and third cam 16, 23, they will be described with reference to FIG. 3 which shows them in perspective. The first cam 16 is of a substantially cylindrical shape having a central bore 16*d* in which the rotatable shaft 5 is fitted, the first cam 16 being substantially symmetrical with respect to the central axis of the central bore 16*d*. The first cam 16 has on its outer circumferential surface a circumferential surface 16*j* on which an inner circumferential surface 23*c* of the third cam 23 is journalled. The circumferential surface 16*e* extends in confronting relation to the portion 8*g*-1 of the carriage 8. First and second stepped surfaces 16*f*, 16*g* extends perpendicularly to the axis of the rotatable shaft 5 and are selectively engageable with a side face 8*g*-2 of the portion 8*g*-1 in certain modes of operation. A surface 16*h* extends from one end of the first stepped surface 16*f* normally thereto. The first cam 16 also has a third stepped surface 16*l*. As described above, the tooth 16*c* of substantially triangular cross-section, projecting from the annular surface 16*b* of the first cam 16 disposed deep within the cylinder thereof and extending perpendicularly to the rotatable shaft 5, is engageable with the tooth 17*c* of substantially triangular cross-section projecting from the end face 17*b* of the second cam 17.

Figure 3:
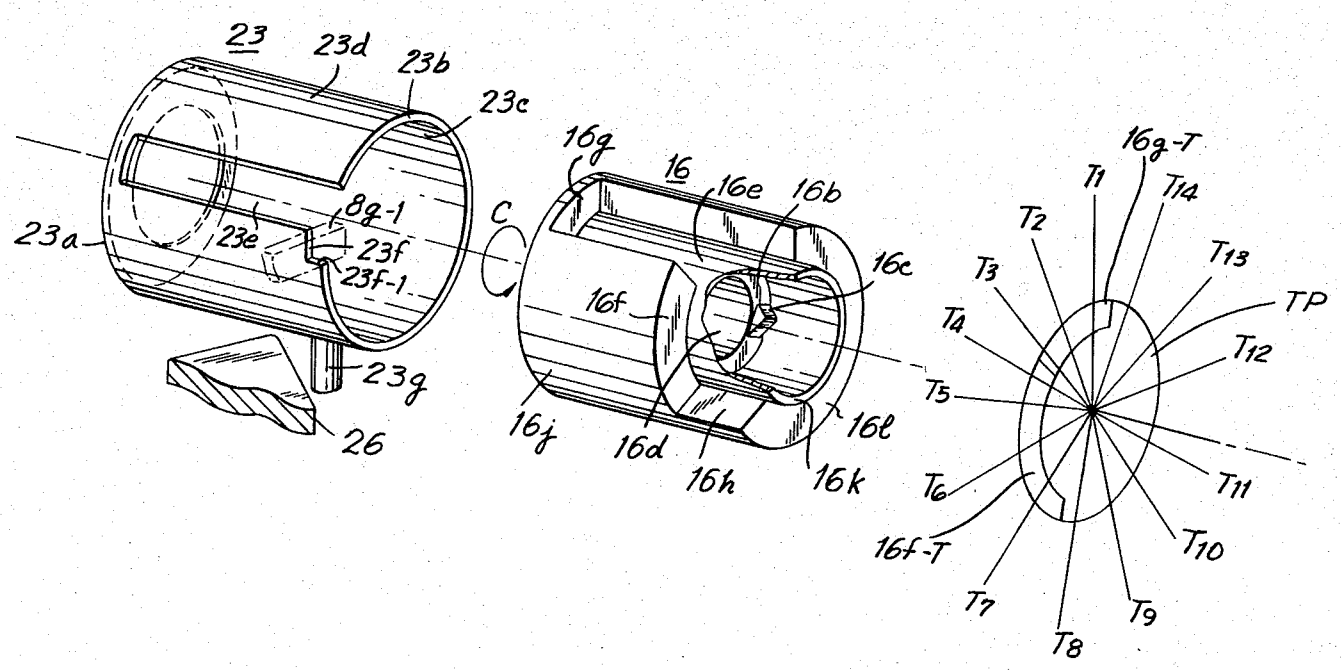
FIG. 3 is an exploded perspective view to an enlarged scale of first and third cam in the serial printer in FIG. 1.

As illustrated in FIG. 3, the third cam 23 is also of a substantially cylindrical shape including the inner circumferential surface 23*c* journalled on the circumferential surface 16*j* of the first clutch means 16. The third cam 23 also includes an outer circumferential surface 23*d*, a guide slot 23*e* defined in the cylindrical wall, a recessed stepped surface 23*f* defined contiguously to the guide slot 23*e* at an end face 23*b* of the cylindrical wall and partly defined by a wall 23*f*-1 extending parallel to the axis of the third cam 23, and a cylindrical projection 23*g* extending radially from the outer circumferential surface 23*d*.

FIG. 1 shows three type wheels 3. The type wheel 3 supporting the types 3S thereon serves basically as a first or symbol type wheel 3-3S for printing characters indicative of the kind of numerals printed across lines. The first type wheel 3-3S usually prints symbols in the first line in most cases. The type wheel 3 supporting the types 3B thereon serves basically as a second or numeral type wheel 3-3B for printing numerals and is coated with ink of a first color for printing the numerals in the first color. The type wheel 3 supporting the types 3R thereon serves basically as a third or numeral type wheel 3-3R and is coated with ink of a second color for printing numerals in the second color.

In FIG. 1, the fourteen types 3S are shown as being selectively actuatable to print a selected numeral in the first digit position. The driver shaft 12 is not yet rotated, and the rotatable shaft 5 is driven by a drive source (not shown) comprising a motor and a gear train to rotate clockwise about its own axis when viewed in the direction of the arrow B. At this time, the rotatable shaft 5, the second cam 17, and the holder 4 rotate in unison, and the third cam 23 is stopped against rotation by the portion 8*g*-1 of the carriage 8 engaging the wall 23*f*-1 after having initially rotated due to frictional engagement between the holder 4 and the end surface 23*a* of the third cam 23. The first cam 16 is braked by the third cam 23 journalled thereon and the carriage stopper 18 frictionally engaging therewith against rotation due to frictional forces from the rotatable shaft 5 or the holder 4 until the tooth 16*c* is pushed by the tooth 17*c* at which time the first and second cam 16, 17 engage to rotate together. This condition continues until a later time described later on.

The presser 7*a* of the hammer 7 is positioned at this time in confronting relation to the symbol type wheel 3-3S. While the type wheels 3 on the holder 4 rotate with the rotatable shaft 5, a detector 24 mounted on an end of the rotatable shaft 5 successively produces character position detection signals corresponding respectively to the type or characters on the type wheels 3 until a desired type 3S faces the sheet 2.

More specifically, the detector 24 comprises, as illustrated in FIG. 1, a disc 24-1 secured to the rotatable shaft 5 and supporting electric conductors 24-4, 24-5 positioned in contact with fixed detector brushes 24-2, 24-3, respectively, which are resiliently held against the disc 24-1 under the bias of springs. The electric conductors 24-4, 24-5 are rendered electrically conductive with each other at all times. The electric conductor 24-4 is completely continuous in the circumferential direction at the radial position where the detector brush 24-3 contacts the disc 24-1. The electric conductor 24-5 has discrete portions, separated at angular intervals defined by dividing the angle 360° by the number of types on a single type wheel (here 14), at the radial position where the detector brush 24-2 contacts the disc 24-1. As the disc 24-1 rotates, therefore, conduction signals or character position detection signals corresponding respectively to the character positions are generated across terminals 24-6, 24-7 of the detector brushes 24-2, 24-3, respectively.

When a desired one of such character position detection signals is produced by the detector 24, an electromagnet (not shown) is energized to actuate a means for stopping the rotatable shaft 5 or to actuate a character selecting means to stop and retain the rotatable shaft 5 and hence the type wheels 3 for character selection. At the same time, a mechanism for stopping and retaining the driver shaft 12 is released to cause the driver shaft 12 to rotate counterclockwise about its axis as viewed in the direction of the arrow B. While the driver shaft 12 makes one revolution, a desired character or symbol on the type wheel 3-3S is printed on the sheet 2, and the carriage 8 is shifted in the B direction by one character. When the shifting of the carriage 8 has been completed, the driver shaft 12 stops rotating and the rotatable shaft 5 is rendered free to rotate, whereupon the type wheels 3 start rotating again for character selection.

Figure 4:
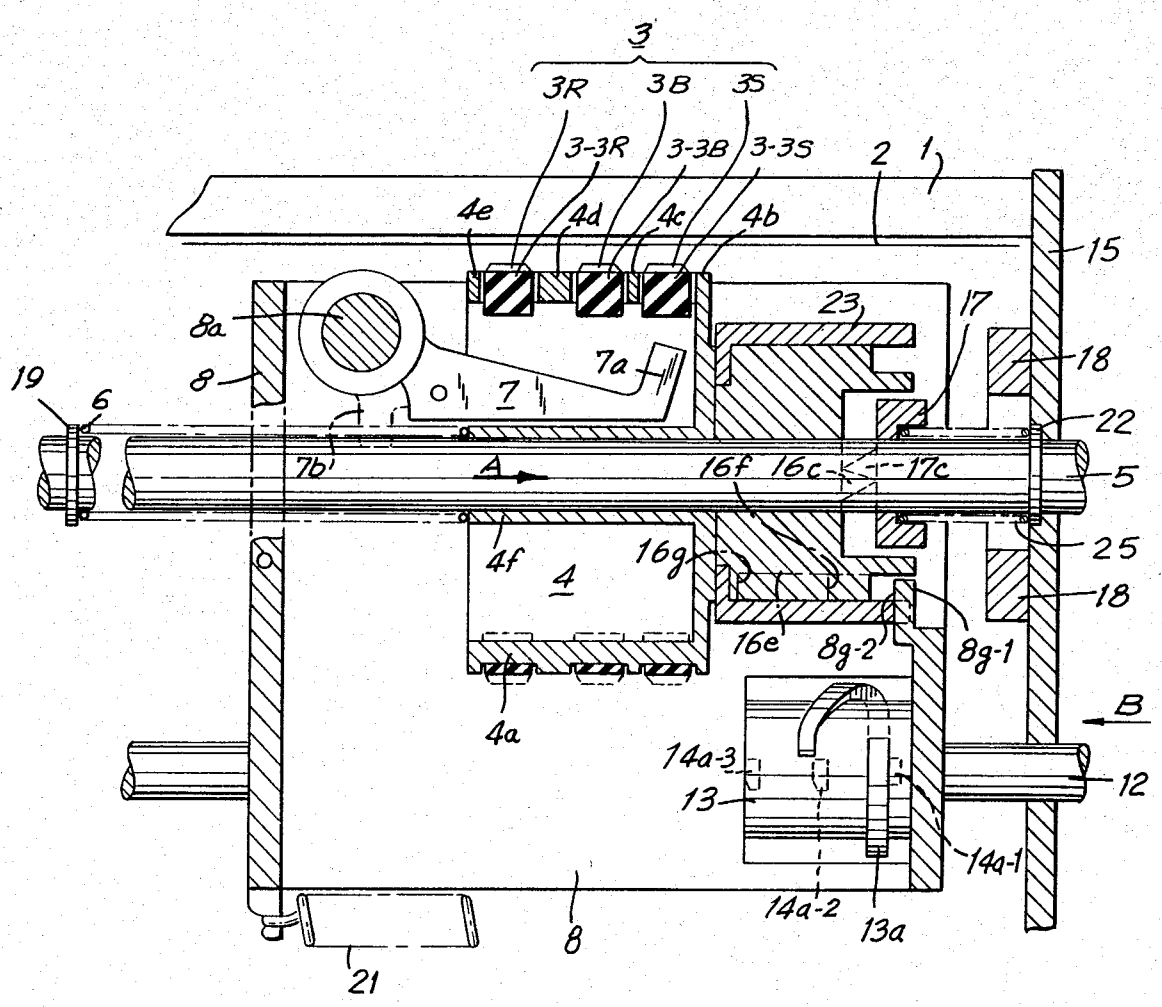

FIG. 4 is illustrative of such a condition of operation after a shift of one stop from that illustrated in FIG. 1. For the sake of brevity, portions from FIG. 1, unnecessary for the description, are omitted in FIG. 4. In the illustrated position, the ridge 13*a* of the carriage shifting cam 13 is held in meshing engagement with a tooth 14*a*-1 on the positioning plate 14. The interval by which the carriage 8 and hence the hammer 7 are shifted from the first character position to this second character position can be adjusted by selecting the position of the tooth 14*a*-1.

During the process of such carriage shifting, the portion 8*g*-1 of the carriage 8 pushes with its end surface 8*g*-2 against the recessed stepped surface 23*f* in the third cam 23. The third cam 23 and hence the type wheels 3 thus move in the direction of the arrow B by an interval which is substantially the same as the interval of travel of the carriage 8 and hence the hammer 7 except for the slight clearance present between the recessed stepped surface 23*f* and the end surface 8*g*-2 when the carriage 8 is in the standby position as shown in FIG. 1. The presser 7*a* of the hammer 7 remains facing the type wheel 3-3S. At this time, the teeth 16*c*, 17*c* are kept in mutual engagement as the second cam 17 is urged toward the first cam 16 under the force of the compression coil spring 25. In the second character position of the carriage, a desired character is selected and printed, and the carriage 8 can be shifted to the third character position.

When the carriage 8 has been shifted to the third character position, the ridge 13*a* is in mesh with a tooth 14*a*-2 on the positioning plate 14. The presser 7*a* of the hammer 7 is positioned still in confronting relation to the type wheel 3-3S as in the second character position. The carriage 8, the first cam 16, the second cam 17, the third cam 23, the holder 4, and the type wheels 3 remain in the same relative position as that of the second character position as shown in FIG. 4.

The color in which characters are printed in the following character positions is determined by the manner in which a character position is selected in the third position through the mechanism according to the present invention, as described below.

As illustrated in FIG. 3, with the portion 8*g*-1 of the carriage 8, nonrotatable relative to the type wheels 3 being a reference, the character position detection signals Tn (n=1 through 14) corresponding to the character positions on the type wheels 3 are generated while the type wheels 3 and the disc 24-1 are being rotated. The character position detection signals Tn are illustrated in FIG. 3 positionally on an imaginary plane TP, and the first and second stepped surfaces 16*f*, 16*g* in the first cam 16 are projected onto the imaginary plane TP respectively as areas 16*f*-T, 16*g*-T.

A printing operation in a first color will be described first. When a character corresponding to a signal T5 or T6 (hereinafter referred to as a "B signal"), falling sufficiently in the area 16*f*-T even with mechanical tolerances considered, is selected (hereinafter referred to as "B selection"), the selected character is printed in the third character position on the line and then the carriage 8 is shifted to the fourth character position. During the shifting process, the projection of the portion 8*g*-1 of the carriage 8 onto the imaginary plane TP is fully contained in the area 16*f*-T, that is, the portion 8*g*-1 confronts the first stepped surface 16*f*.

When the carriage 8 is shifted from the third to the fourth character position, the projection 23*g* on the third cam 23 slides along a cam face 26 fixedly mounted on the frame 15, or the like, to forcibly rotate the third cam 23. The third cam 23 is rotated in the direction of the arrow C (FIG. 3), counterclockwise about the axis when viewed in the direction of the arrow B (FIG. 4), for an angular interval determined by the cam face 26. The portion 8*g*-1 of the carriage 8 is then positioned circumferentially within the width of the guide slot 23*e*. When the portion 8*g*-1 is thus located, the first clutch means 16, the third cam 23 and the holder 4 are shifted back to the lower character position on the line until the portion 8*g*-1 abuts against the first stepped surface 16*f* in the first cam 16 with the portion 8*g*-1 guided in the guide slot 23*e* under the force of the compression coil spring 6 acting on the holder 4 and hence the third and first cam 23, 16. The second clutch means 17 is also shifted back to the lower character position. The compression coil spring 25 is designed to produce a spring force smaller than that of the compression coil spring 6.

Figure 5:
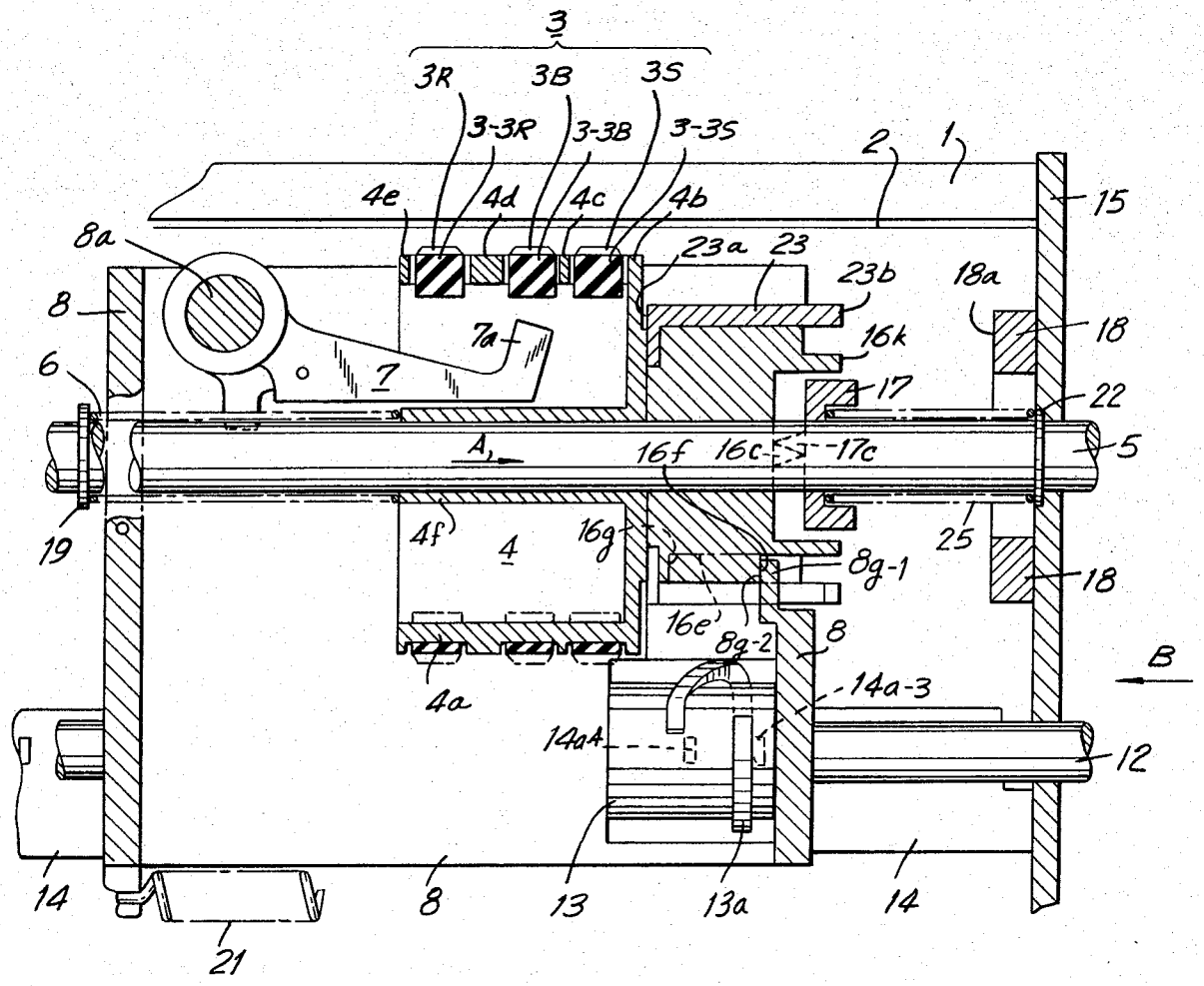

FIG. 5 shows the position of the parts just after the carriage 8 is shifted to the fourth character position on the line. In this position, the presser 7*a* of the hammer 7 is located exactly in a confronting relationship to the first-color printing type wheel 3-3B for printing characters in first color, e.g., mainly numerical information in electronic desktop calculators. The first stepped surface 16*f* is positionally defined to assure the foregoing positioning of the parts.

For selecting a character on the fourth digit position, the rotatable shaft 5, the second cam 17, the first cam 16, the third cam 23 and the holder 4 start rotating from the position of FIG. 5. However, first and third cam 16, 23 are prevented from rotation as the portion 8*g*-1 of the carriage 8 is disposed in the guide slot 23*e* in the third cam 23 and the surface 16*h* of the first cam 16 engages the portion 8*g*-1. At this time, the tooth 17*c* which is trangular in cross-section is forced under an excessive load to disengage temporally from the tooth 16*c* which is also of triangular cross-section, whereupon the second cam 17 is thus moved to the lower digit position as the compression coil spring 6 is stronger than the compression coil spring 25 which hence becomes compressed.

With the presser 7*a* of the hammer 7 facing the type wheel 3-3B, therefore, a desired character can be selected and printed in the fourth character position on the line. Similarly, in the fifth character position and following character positions on the line, the carriage 8 is shifted in increments with the presser 7*a* remaining in confronting relation to the type wheel 3-3B for enabling desired characters thereon to be selected and printed. Accordingly, characters can be printed in the first color in the fourth and successive character positions on the line. Since it is basically preferable to allow the teeth 16*c*, 17*c* to disengage from each other in the fourth and successive character positions, the compression coil spring 25 is designed such that its length in its free state and spring force thereof are determined to assure such disengagement.

An operation for printing characters in the second color will now be described. When a character corresponding to a signal T1 or T2 (hereinafter referred to as an "R signal"), falling sufficiently in the area 16*g*-T even with mechanical tolerances considered, is selected (hereinafter referred to as "R selection"), the selected character is printed in the third character position on the line and then the carriage 8 is shifted to the fourth character position. At this time, the portion 8*g*-1 of the carriage 8 confronts the second stepped surface 16*g* in the first clutch means 16. When the carraige 8 is shifted to the fourth character position, the first cam 16, the third cam 23 and the holder 4 are moved in unison toward the lower character position until the end surface 8*g*-2 of the portion 8*g*-1 engages the second stepped surface 16*g*. The second cam 17 is also shifted back to the lower character position.

Figure 6:
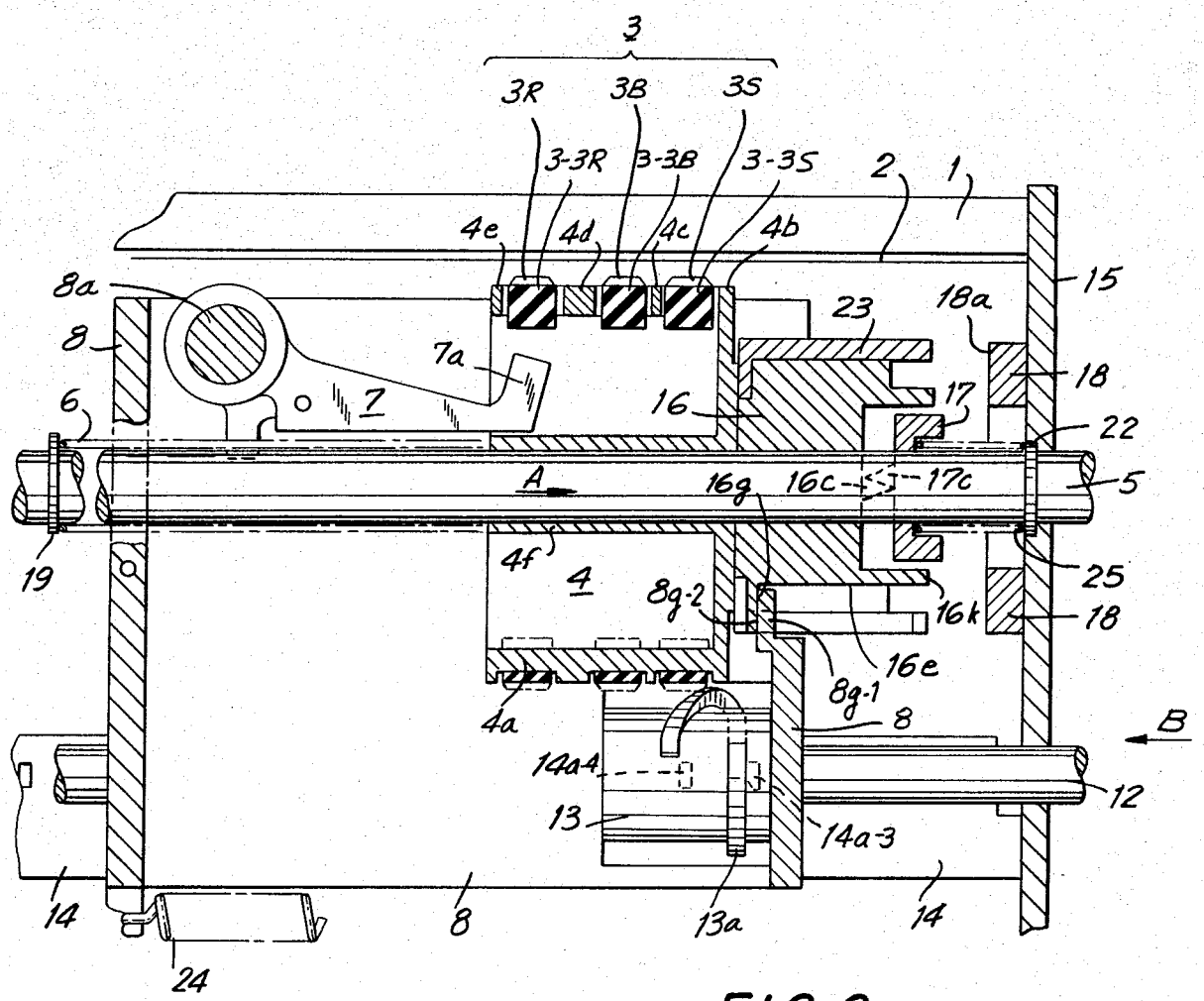

Such a condition is shown in FIG. 6. The presser 7*a* of the hammer 7 now faces the second-color printing type wheel 3-3R for printing characters in the second color, e.g., mainly numerical information in electronic desktop calculators. The second stepped surface 16*g* is positionally defined to assure the foregoing positioning of the parts. After a desired character on the type wheel 3-3R has been selected and printed, the carriage 8 is shifted to the fifth and successive character positions on the line, during which time the presser 7*a* is kept in confronting relation to the type wheel 3-3R. Therefore, characters can be printed in the second color in the fourth and successive character positions.

In the foregoing description characters are printed in the third character position. Since only a certain group of characters can be selected due to the B selection and R selection, each character group (character group B for the B selection and character group R for the R selection) should preferably contain at least one blank character that may be selected in the third character position in the B selection or the R selection for the readability of printed characters.

The projection 23*g* on the third cam 23, journalled on the first cam 16, and the cam face 26 fixed to the frame jointly serve as a trigger means (which serves as part of switching means of the first or the second color printing) for shifting the holder 4 to the lower character position to allow the presser 7*a* to face the type wheel 3-3B or 3-3R after the carriage 8 has been shifted from the third character position to the fourth character position. Such a trigger means may be constructed according to a second embodiment shown in FIG. 7.

In the second embodiment, selected portions of the mechanism for the B or R selection are partly modified into different structures from the first embodiment. The difference between the first and second embodiment is that the third cam 23 is replaced with a lever 31 insertable between a stepped surface 16*l* of the first cam 16 and the end surface 8*g*-2 of the portion 8*g*-1 of the carriage 8. The lever 31 can be inserted into or pulled out of the gap between the stepped surface 16*l* and the end surface 8*g*-2 by a guide assembly (not shown) which may comprise a pivot means for allowing rotation of the lever 31 thereabout and a wall for preventing the lever 31 from teetering accidentally in the direction of the arrow B or the opposite direction.

Figure 7:
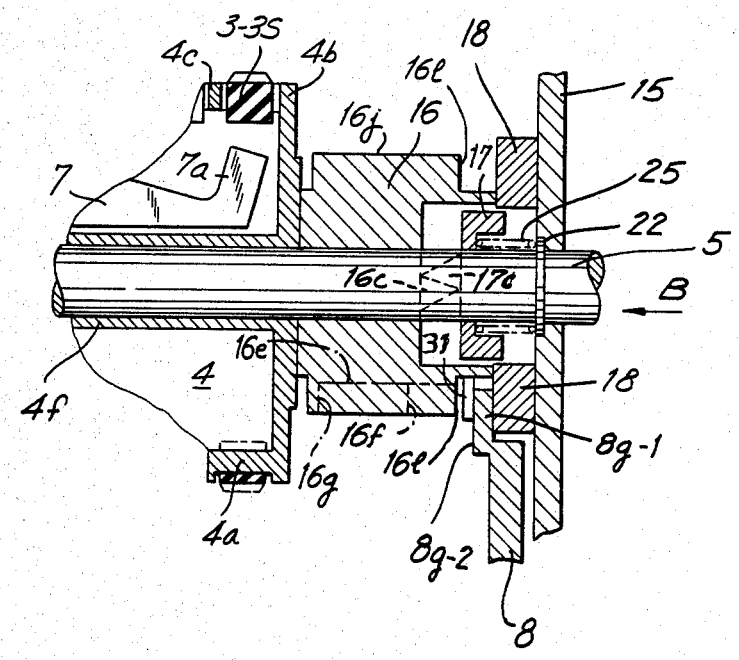
FIG. 7 is a partial top sectional view of an alternative embodiment of a serial printer in accordance with the invention.

When the carriage 8 is shifted successively with the lever 31 inserted between the stepped surface 16*l* and the end surface 8*g*-2, as shown in FIG. 7, the presser 7*a* remains facing the type wheel 3-3S. Upon shifting movement of the carriage 8 from the third character position to the fourth character position, the lever 31 is forcibly pulled out by a cam fixed to the frame such as the cam face 26 in the first embodiment, thus triggering the holder 4 to move axially with respect to the carriage 8 for the B or R selection. The lever 31 should preferably be normally urged by an urging means to be inserted between the stepped surface 16*l* and the end surface 8*g*-2. After the B selection or the R selection has been effected, the lever 31 is brought into engagement with and retained on the outer circumferential surface 16*j* of the first cam 16 under the resiliency of the urging means, as is evident from the drawings.

While the tooth 16*c* of the first cam 16 and the tooth 17*c* of the second cam 17 have been described and shown as being provided in a pair, they may be provided in two pairs. Where the pairs of teeth 16*c*, 17*c* are angularly spaced 180° from each other in symmetrical positions, the first and second cam 16, 17 are angularly movable through 180° in opposite directions when the teeth 16*c*, 17*c* mesh with each other upon returning of the carriage 8, the holder 4 and the like to the standby position (FIG. 1) after one line has been printed. To cope with this, the portion 8*g*-1 of the carriage 8, the first stepped surface 16*f*, and the second stepped surface 16*g* may each be provided in an identically shaped pair in symmetrical relation with respect to the axis of the rotatable shaft 5, for thereby enabling the B or R selection successfully. This arrangement allows earlier arrival of the character position detection signal Tn capable of the B or R selection in the third digit position on the line, reducing the time required for printing a single line. The teeth 16*c*, 17*c*, the portion 8*g*-1, the first and second stepped surfaces 16*f*, 16*g* may each be provided also in three or more parts.

The cam face 26 fixed to the frame and serving as part of the trigger means for the B or R selection may be positioned such that it will not trigger the B or R selection between the third and fourth digit positions, but between other digit positions on the line. When the cam face 26 is located for allowing character selection triggering between the second and third digit positions, any character on the type wheel 3-3S can be printed only on the first digit position on the line. When the cam face 26 is positioned for character triggering selection between the fourth and fifth digit positions, the type wheel 3-3S can print its symbols on the first, second and third digit positions. This permits characters to be printed in the first or second color in digit positions higher than a desired digit position.

While the number of characters on each type wheel 3 has been described as being fourteen, the number of such characters should not be interpreted as being limitative. The present invention is not limited to the use of a single symbol type wheel 3-3S, but is applicable to those serial printers which have two or more symbol type wheels with the foregoing description applied to one of such symbol type wheels which is in the highest character position and the other numerical type wheels.

In the above embodiments, the first stepped surface 16*f* for the B selection and the second stepped surface 16*g* for the R selection are defined in the first clutch means 16. The serial printer may include additional type wheels 3 for printing characters in third and fourth colors and inking means therefor, and the first cam 16 may additionally have stepped surfaces for enabling the additional type wheels 3 to print characters in the third and fourth colors. This arrangement can provide a multicolor type-printing printer capable of printing characters in a desired number of colors.

The means for supplying ink will next be described. FIG. 8 is a horizontal cross-sectional view showing parts of the serial printer in accordance with the first embodiment which are related to the ink supplying means. A cylindrical ink roll assembly 30 is made of a porous material impregnated with ink, and comprises a first-color ink roll 30B and a second-color ink roll 30R. The ink roll assembly 30 is fitted over an ink roll shaft 29 loosely fitted in holes or recesses 8*h*, 8*i* defined in vertical walls of the carriage 8. The ink rolls 30B, 30R are disposed in sandwiching relation to a separator flange 29*a* secured to the ink roll shaft 29 for rotation therewith. An ink roll cover 28 is journalled on the ink roll shaft 29 and includes a pair of arms 28*c*, 28*d* gripping the ink roll assembly 30 therebetween and terminating in respective arm ends 28*a*, 28*b* which sandwich the flange 4*b* and the circumferential rib 4*e* of the holder 4.

Although not shown, the ink roll cover 28 is pushed in the direction of the arrow D by an urging means such as a spring to press the ink roll assembly 30 against the types 3S, 3B, 3R for transferring ink to the latter. Since the holder 4 is gripped between the arm ends 28*a*, 28*b*, the ink roll assembly 30 and the type wheels 3 are kept in a fixed relative axial position even when the carriage 8 and the holder 4, which is supported on the rotatable shaft 5, are relatively moved in the axial direction, e.g., when the carriage 8 is moved relatively to the holder 4 toward the position shown with two-dot-and-dash lines (FIG. 8). The ink roll 30B is held against the type wheels 3-3S, 3-3B, and the ink roll 30R is held against the type wheel 3-3R, at all times. With the illustrated embodiment, the characters printed by the types 3S are of the first color at all times.

A second separator flange may be positioned on the ink roll shaft 29 in alignment with the circumferential rib 4*c* to divide the ink roll 30B into two ink roll sections. One of such ink roll sections which confronts the type wheel 3-3S may be impregnated with ink of a third color. With this ink roll arrangment, numerical information and symbol information indicating divisions of the numerical information in electronic desktop calculator can clearly be separated in color, and printed data can be rendered visible with ease.

Instead of sandwiching the holder 4 between the arm ends 28*a*, 28*b*, the circumferential rib 4*d* may have in its outer circumferential surface a groove in which a radial outward edge of the separator flange 29*a* may be inserted for preventing the ink roller assembly 30 and the type wheels 3 from moving relatively to each other.

The ink roll assembly 30 may be dispensed with, and the type wheels 3 may be made of a material capable of being impregnated with ink and may be impregnated with ink in advance. Alternately, ink may additionally be supplied to such ink-impregnated type wheels 3 by the ink roll assembly 30 to better wet the type wheels 3 with ink.

With the arrangement of the foregoing embodiments, characters can be printed in a first color, a second color, and multiple colors from the lowest character position on the line, and characters can be selected with slightly different timing in the characters or digit position (the third character position in the above embodiments) for selecting the first color (B selection), the second color (R selection), and other colors. Provided that the same combination of characters and the same number of character positions are to be printed, one line can be printed in different colors in substantially the same interval of time, a feature which can overcome the problems with prior art printers. The type-printing serial printer of the invention can print characters in two colors that have not been available heretofore, and have two or more independent symbol type wheels. Symbols can be printed also in a third color, and numerical information can be printed in three or more colors which can be selected as desired. The serial printer of the invention is believed to be of highly effective use in fields in which a serial printer can be incorporated, such as electronic desktop calculators. The present invention is therefore highly advantageous.

A third embodiment of the present invention will now be described with reference to FIGS. 9 through 15.

Figure 9:
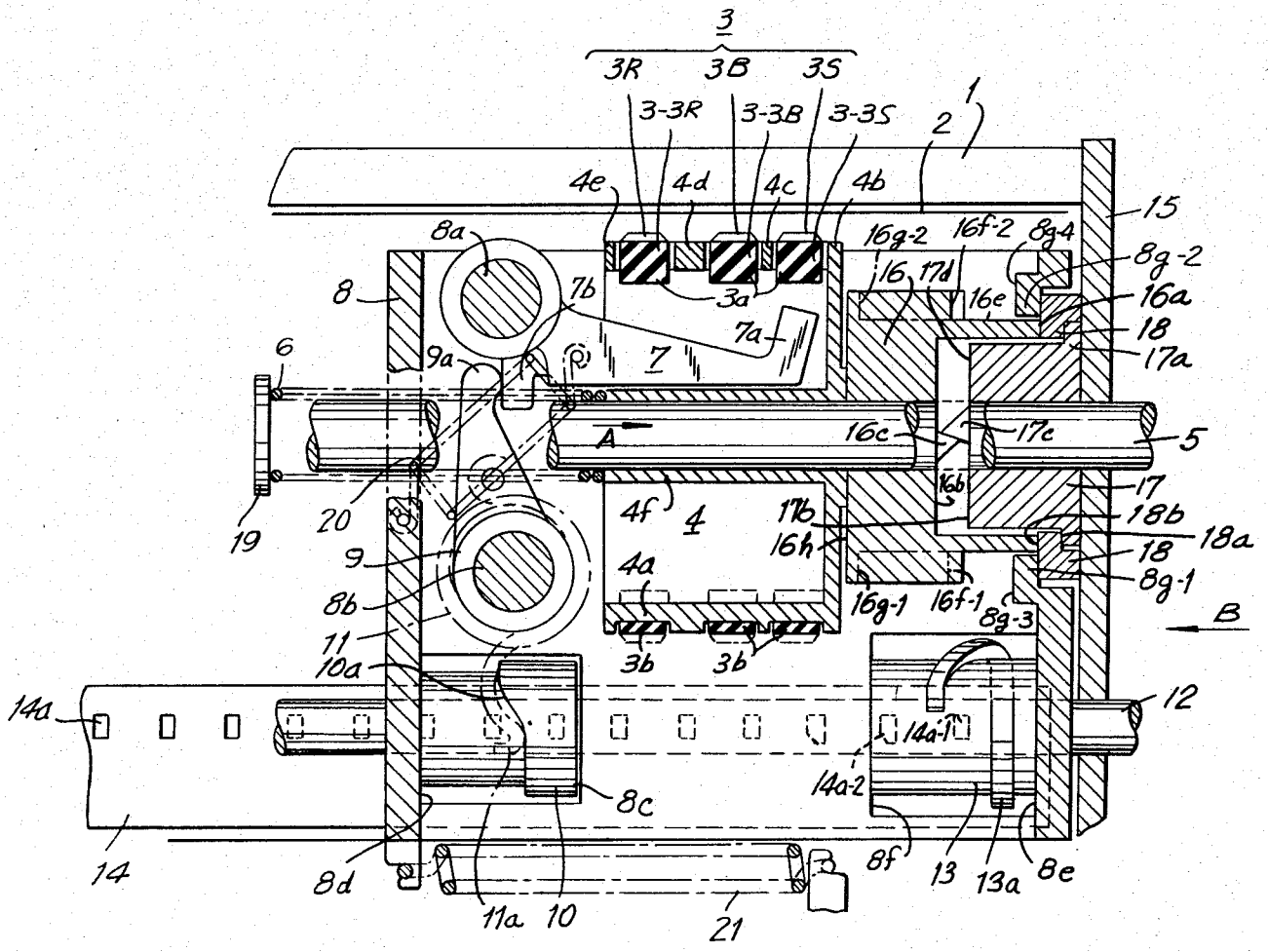
FIGS. 9, 12, 13, 14 and 15 are top sectional views of another alternative embodiment of a serial printer in accordance with the invention showing positions for a sequence of printer operation.

A serial printer according to the third embodiment is used in an electronic desktop calculator or the like and can print characters on a sheet 2 of printing paper successively from the lowest character or digit position (at the right as shown). In FIG. 9, a carriage 8 and type wheels 3 are urged toward the standby position (at the right-hand end) under the forces of a compression coil spring 6 and a tension coil spring 21. A first cam 16 of a substantially symmetrical configuration with respect to an axial line is interposed between a flange 4*b* of a holder 4 and a frame 15 and held against the flange 4*b*. The first cam 16 is fitted over a rotatable shaft 5 for axial slidable movement therealong and free rotatable movement therearound.

Switching means of color or printed characters having a second cam 17 of a substantially symmetrical configuration with respect to an axial line is fitted over the rotatable shaft 5 for rotation therewith about its axis. An annular carriage stopper 18 is fixed to the frame 15 and held against portions 8*g*-1, 8*g*-2 of the carriage 8. The second cam 17 has a flange 17*a* sandwiched between the frame 15 and a stepped surface 18*a* of the carriage stopper 18 so that the second cam 17 can basically be retained against axial movement along the rotatable shaft 5. The carriage stopper 18 has an end surface 18*b* slidably held against an end surface 16*a* of the first cam 16. The first and second cam 16, 17 have opposite annular surfaces 16*b*, 17*b* on which there are mounted at least a pair of teeth 16*c*, 17*c* of substantially triangular cross-section engageable with each other when the first and second cam 16, 17 rotate around the rotatable shaft 5. Although not clearly shown in FIG. 9, two pair of such teeth are disposed in symmetrical relation with respect to the axis of rotation of the rotatable shaft 5, the advantage of which arrangement will be described later on.

Figure 11:
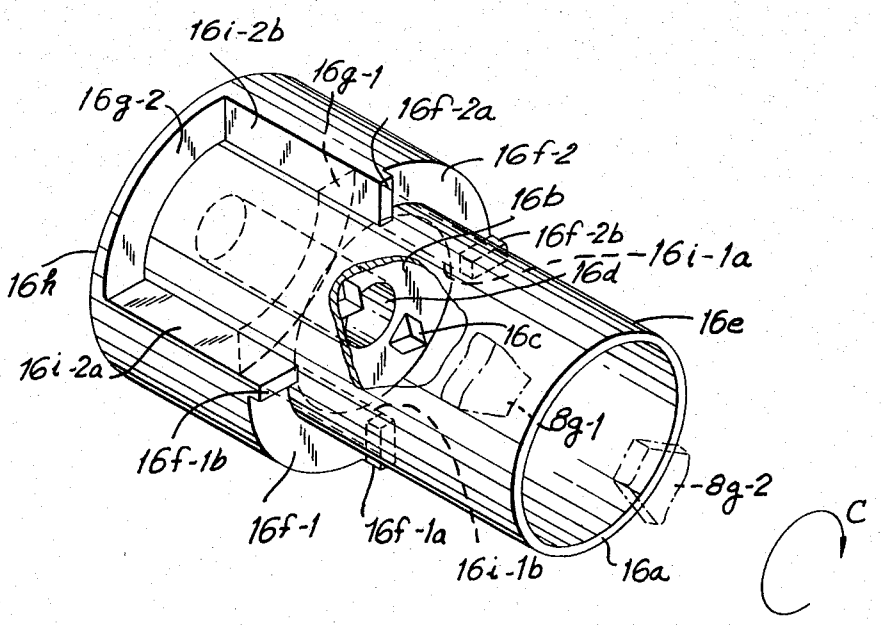
FIG. 11 is a perspective view of a first clutch means in the serial printer of FIG. 9.

The first cam 16 will be described with reference to FIG. 11 which shows the same in perspective for a better understanding of the shape of the first cam 16. The first cam 16 is substantially cylindrical in shape and has a central hole 16*d* in which the rotatable shaft 5 is fitted, the first cam 16 being substantially symmetrical with respect to the central axis of the hole 16*d*. The first cam 16 has on its outer circumferential surface a circumferential surface 16*e* confronting the portion 8*g*-1 or 8*g*-2 of the carriage 8, first stepped surfaces 16*f*-1, 16*f*-2 and second stepped surfaces 16*g*-1, 16*g*-2 extending normally to the axis of the rotatable shaft 5 and engageable in certain modes of operation with side faces 8*g*-3, 8*g*-4 of the portions 8*g*-1, 8*g*-2, respectively, and projections 16*f*-1*a*, 16*f*-1*b*, 16*f*-2*a*, 16*f*-2*b* at the ends of the first stepped surfaces 16*f*-1, 16*f*-2. The distances from an end surface 16*h* of the first cam 16 to the first stepped surfaces 16*f*-1, 16*f*-2 are equal to each other, and those from the end surface 16*h* to the second stepped surfaces 16*g*-1, 16*g*-2 are equal to each other. The cylindrical surface 16*e* should preferably be of an equal diameter up to the second stepped surfaces 16*g*-1, 16*g*-2. As described above, the two teeth 16*c* of substantially triangular cross-section extend from the annular surface 16*b* extending perpendicularly to the rotatable shaft 5 deeply within the cylinder of the first cam 16, and the two teeth 17*c* of substantially triangular cross-section extend from the annular surface 17*b* of the second cam 17, the teeth 16*c*, 17*c* being engageable with each other upon relative rotation of the first and second cam 16, 17.

FIG. 9 shows three type wheels 3. The type wheel 3 supporting the types 3S thereon serves basically as a first or symbol type wheel 3-3S for printing characters indicative of the kind of numerals printed across lines. The first type wheel 3-3S usually prints symbols in the first line in most cases. The type wheel 3 supporting the types 3B thereon serves basically as a second or numeral type wheel 3-3B for printing numerals and is coated with ink of a first color supplied from an ink roller for printing the numerals in the first color. The type wheel 3 supporting the types 3R thereon serves basically as a third or numeral type wheel 3-3R and is coated with ink of a second color supplied from an ink roller for printing numerals in the second color.

In FIG. 9, the fourteen types 3S are shown as being selectively actuatable to print a selected numeral in the first digit position. The driver shaft 12 is not yet rotated, and the rotatable shaft 5 is driven by a drive source (not shown) comprising a motor and a gear train to rotate clockwise about its own axis when viewed in the direction of the arrow B. At this time, the first clutch 16 is free to rotate as the portion 8*g*-1 or 8*g*-2 of the carriage 8 is located adjacent to but spaced from the cylindrical surface 16*e* of the first cam 16. The first clutch 16 may be rotated with its teeth 16*c* engaging the teeth 17*c*, or may be idle on the rotatable shaft 2 with the teeth 16*c* held out of engagement with the teeth 17*c*. At any rate, the rotatable shaft 5 is not subjected to any force tending to stop its rotation. A presser 7*a* of a hammer 7 is positioned in confronting relation to the symbol type wheel 3-3S. The holder 4 and hence the type wheels 3 rotate with the rotatable shaft 5. When a desired type 3S is brought into confronting relation to the sheet 2 during such rotation, a corresponding one of the character position detection signals, that correspond respectively to the character positions on the type wheel, is generated to energize an electromagnet or the like for thereby actuating a means for stopping the rotatable shaft 5 (that is, a character selecting means), and simultaneously releasing a mechanism for stopping the rotation of the driver shaft 12. The driver shaft 12 is then allowed to make one revolution counterclockwise about its own axis as viewed in the direction of the arrow B. While the driver shaft 12 makes one revolution, a desired symbol type is printed on the sheet 2, and the carriage is shifted to a next character or digit position on the line. Simultaneously, with completion of such shifting movement of the carriage, the driver shaft 12 is held at rest, and the rotatable shaft 5 is permitted to start rotating so as to be ready for selecting a character again.

Figure 12:
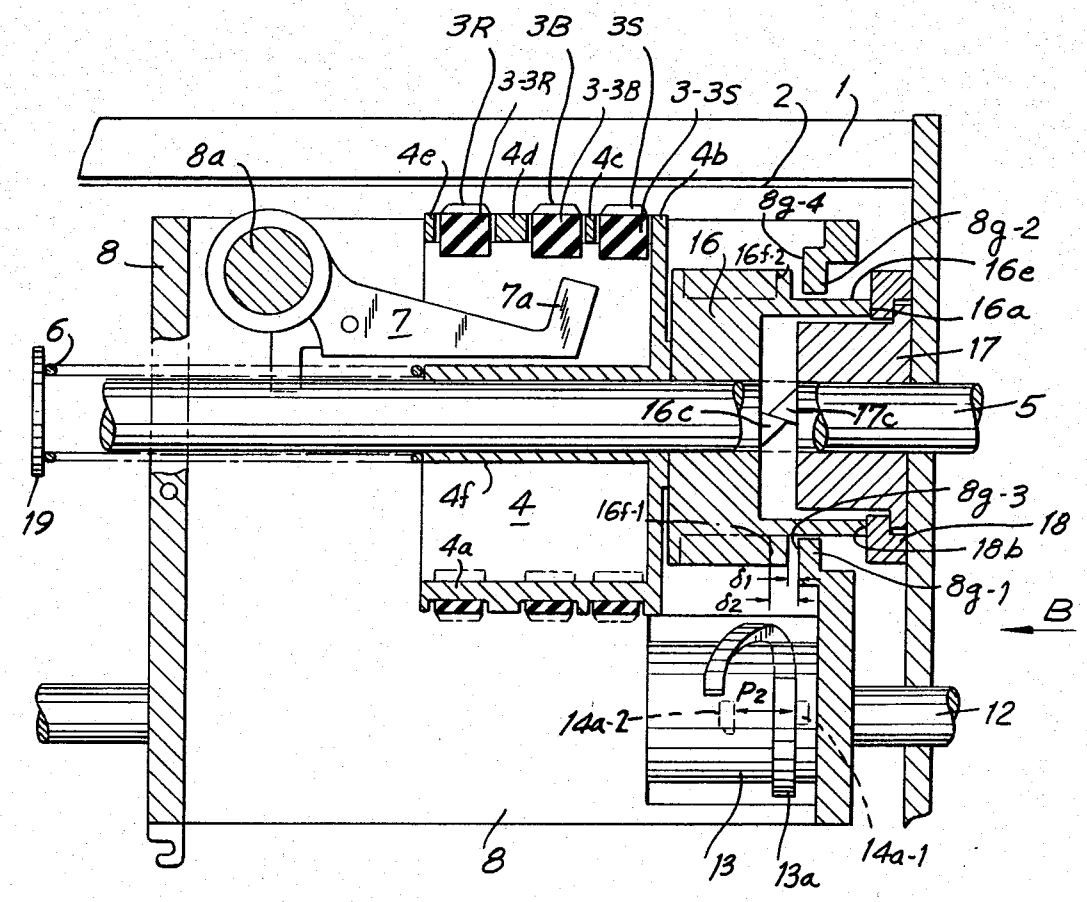

FIG. 12 is illustrative of such a condition of operation. For the sake of brevity, portions of FIG. 9 unnecessary for the description are omitted from FIG. 12. In the illustrated position, a ridge 13*a* of a carriage shifting cam 13 is held in meshing engagement with a tooth 14*a*-1 on a positioning plate 14. The interval by which the carriage 8 and hence, the hammer 7 are shifted from the first character position to this second character position can be selected by adjusting the position of the tooth 14*a*-1 so that such interval will be equal to about half of the distance between the type wheels 3-3S, 3-3B. The ridge 13*a* has a portion which will not produce a lead upon rotation of the carriage shifting cam 13, such a portion being in mesh with the tooth 14*a*-1. During the shifting process, the portions 8*g*-1, 8*g*-2 of the carriage 8 are disposed only in close proximity with the cylindrical surface 16*e* of the first cam 16. Therefore, nothing can prevent the carriage 8 from being shifted. The holder 4 and the first cam 16 remains axially stopped on the rotatable shaft 5 under the bias of the compression coil spring 6. Accordingly, the presser 7*a* of the hammer 7 confronts a circumferential rib 4*c* of the holder 4. At this time, the end surface 16*a* of the first cam 16 is pressed against the end surface 18*b* of the carriage stopper 18, and the first cam 16 is delayed in its rotation with respect to the rotatable shaft 5 due to friction between the first cam 16 and the carriage stopper 18. The teeth 17*c* of the second cam 17 then push the teeth 16*c* of the first cam 16, whereupon the first and second cam 16, 17 and the holder 4 rotate substantially in unison with the rotatable shaft 5. In this condition, as shown in FIG. 12, the portion 8*g*-1 or 8*g*-2 of the carriage 8 is spaced a distance $\delta_1$ from the projections 16*f*-1*a*, 16*f*-1*b* of the first cam 16 in the axial direction of the rotatable shaft 5. A desired character is selected, the hammer 7 is actuated, and the carriage 8 is shifted by a pitch or interval between the teeth 14*a*-2, 14*a*-1 on the position plate 14. It should be noted that during the above process, the presser 7*a* is brought into abutment against the circumferential rib 4*c* of the holder 4 upon actuation of the hammer 7 and hence fails to push the type 3S or 3B into contact with the sheet 2, so that no character will be printed in the second character position on the line.

The character position selected at this time determines whether characters can be printed in the first color in the third and successive character positions or whether characters can be printed in the second color in the fourth or successive character positions. When the type wheels 3 are stopped to select a desired character in order to bring the portion 8*g*-1 of the carriage 8 into exact angular alignment with the first stepped surface 16*f*-1 or 16*f*-2 in the first cam (a mode of operation hereinafter referred to as "B selection"), the printer is in a condition capable of printing the character in the first color. The portion 8*g*-2 is also alignable angularly with the first stepped surface 16*f*-2 or 16*f*-1 exactly as the portions 8*g*-1, 8*g*-2 are located symmetrically with respect to the central axis of the hole 16*d*. When a desired character is selected in order to bring the portion 8*g*-1 into angular alignment with the first stepped surface 16*g*-1 or 16*g*-2 (a mode of operation hereinafter referred to as "R selection"), the printer is in a condition capable of printing the character in the second color.

When characters are selected with the portion 8g-1 or 8g-2 of the carriage 8 being aligned with the first and second stepped surface in the first cam 16, the teeth 16c, 17c are held in mutual engagement, and the selected characters are contained in a certain group of characters and correspond to a certain group of signals out of character position detection signals, thus enabling control of the B or R selection. The manner in which the B or R selection is rendered possible will be described with reference to FIGS. 13, 14 and 15.

Figure 13:
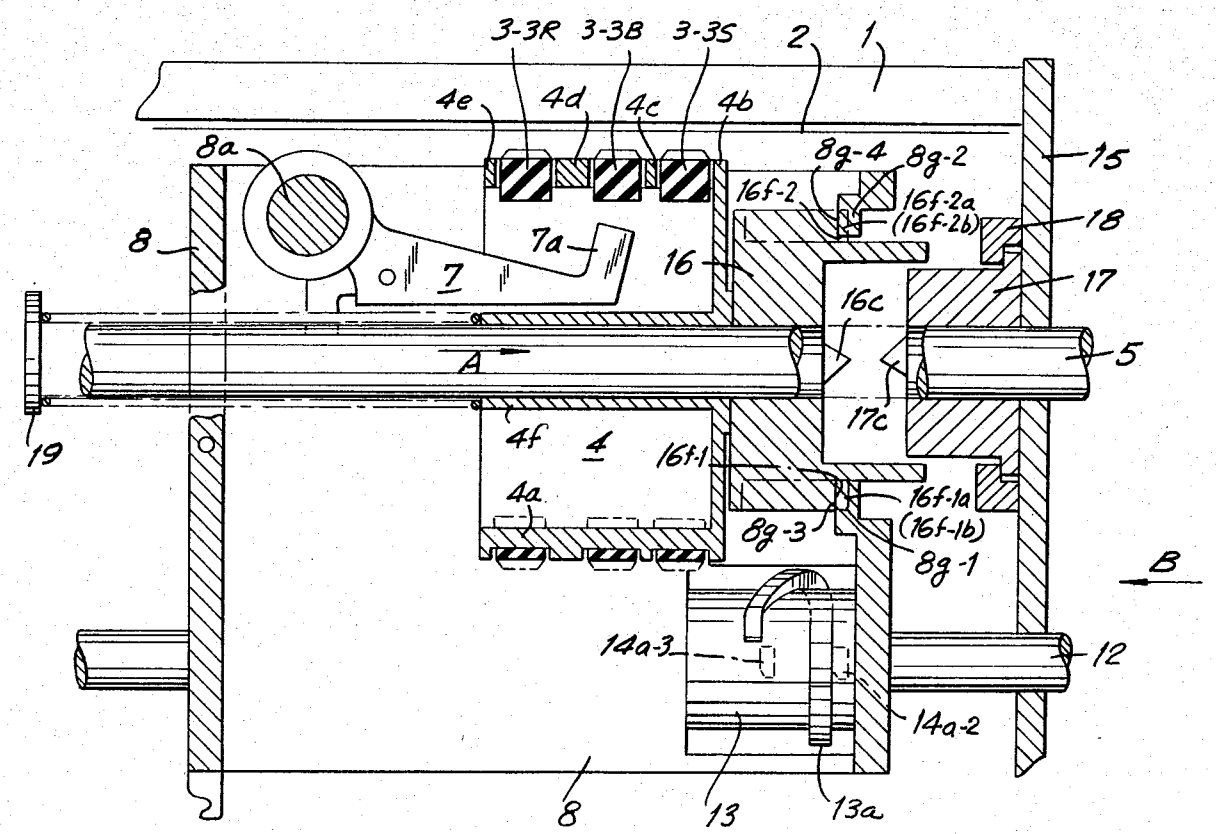

FIG. 13 is illustrative of the position in which the carriage has been shifted to the third character position through the B selection. From the position of FIG. 12, the carriage 8 is shifted by a pitch $P_2$ between the teeth 14a-1, 14a-2. During this shifting process, only the carriage 8 moves in the direction of the arrow B through a distance $\delta_2$ between an end surface 8g-3 or 8g-4 of the portion 8g-1 or 8g-2 and the first stepped surfaces 16f-1 or 16f-2, and then the portions 8g-1, 8g-2 push the first stepped surfaces 16f-1, 16f-2 through a distance $P_2$-$\delta_2$ until carriage shifting is over. Therefore, the holder 4 and the type wheels 3 are pushed in the direction of the arrow B through the distance $P_2$-$\delta_2$. As a result, the presser 7a of the hammer 7 confronts the type wheel 3-3B as illustrated in FIG. 13. Stated otherwise, the distances $P_2$,$\delta_2$ are selected in design to assure the foregoing shifting movement. When the first cam 16 is shifted the distance $P_2$-$\delta_2$, the teeth 16c, 17c become disengaged from each other, and the rotatable shaft 5, the second cam 17 and the holder 4 start rotating in unison. Since the first cam 16 is rotatable with respect to the rotatable shaft 5, the first cam 16 is first delayed in rotation with respect to the rotatable shaft 5 until the portion 8g-1 or 8g-2 engages the projection 16f-1a or 16f-2a, whereupon the first cam 16 stops rotating. The rotatable shaft 5 however keeps on rotating about its own axis. The projections 16f-1a, 16f-2a, 16f-1b, 16f-2b serve to prevent the portions 8g-1, 8g-2 from being displaced out of the first stepped surfaces 16f-1, 16f-2.

In this position, a desired character on the first-color printing type wheel 3-3B is selected and printed on the sheet in the third character position, and then the carriage 8, the first cam 16 and the holder 4 are shifted together to the fourth character position in the direction of the arrow B. In the fourth, fifth and successive character positions, the presser 7a remains the same in its position relative to the type wheel 3-3B in the axial direction of the rotatable shaft 5. Thus, characters can be printed in the first color up to a desired character position. Since characters can be printed in the second color from the fourth character position as described below, a character in the first color in the third character position should be printed by a blank type out of the types 3B for ease in reading the printed characters on the sheet 2.

Figure 14:
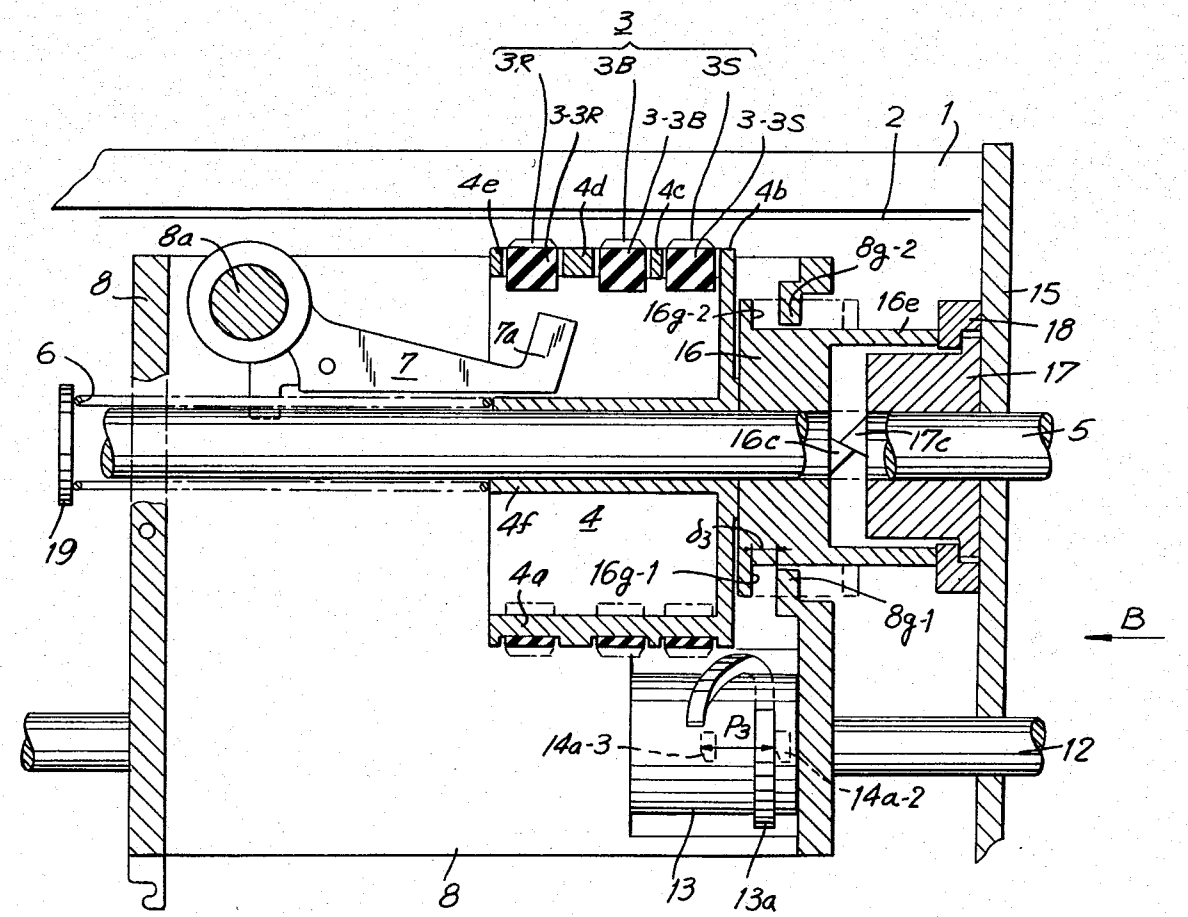

FIG. 14 shows the position of the parts assumed immediately after the carriage 8 has been shifted to the third position through the R selection. The R selection in the position of FIG. 12 is effected such that a character is selected at character selection timing as soon as possible just after the portions 8g-1, 8g-2 have moved past a wall 16i-1b or 16i-2b upon rotation of the first clutch means 16, and the first cam 16 is inactivated. The hammer 7 is then actuated, and the carriage 8 is shifted to the position of FIG. 14.

In this position, the teeth 16c, 17c remain engaging with each other. When the rotatable shaft 5 starts rotating, the first cam 16 also co-rotates in the direction of the arrow C as shown in FIG. 11. Upon angular movement of the first cam 16 through a certain angle, the portions 8g-1, 8g-2 are brought into engagement with those 16i-1a, 16i-2a out of axial walls 16i-1a, 16i-1b, 16i-2a, 16i-2b extending on the opposite ends of the second stepped surfaces 16g-1, 16g-2, whereupon the first cam 16 stops rotating.

At this time, a difficulty tends to arise from the fact that either the teeth 16c, 17c are forced to disengage from each other by movement along the rotatable shaft 5, or the rotatable shaft 5 is forcibly stopped. To prevent such a problem, a character is selected to stop the rotation of the first cam 16, the hammer 7 is actuated, and the carriage is shifted to the fourth character position of FIG. 15 to disenage the teeth 16c, 17c, at suitable timing after the type wheels 3 start rotating from the position of FIG. 14 and before the portions 8g-1, 8g-2 hit the wall 16i-1a or 16i-2a. The pitch between the teeth 14a-2, 14a-1 on the positioning plate 14 and the position and width of the circumferential rib 4d are determined or designed such that the presser 7a of the hammer 7 upon actuation will be engaged by the circumferential rib 4d of the holder 4 in the position of FIG. 14. Accordingly, no character is printed on the sheet 2 no matter which character may be selected in the position of FIG. 14.

In the mode of R selection, the carriage is shifted to the fourth character position of FIG. 14 while no character has been printed on the sheet 2 in the second and third character positions. During the shifting movement from the fourth character position to the fifth character position, the carriage 8 moves an interval equal to a pitch $P_3$ between the teeth 14a-3, 14a-2. Until the portions 8g-1, 8g-2 abut against the second stepped surface 16g-1 or 16g-2, only the carriage 8 moves through a distance $\delta 3$. Thereafter and until the carriage shifting is over, the carriage 8 is shifted while pushing the first cam 16 through a distance $P_3$-$\delta_3$.

Figure 15:
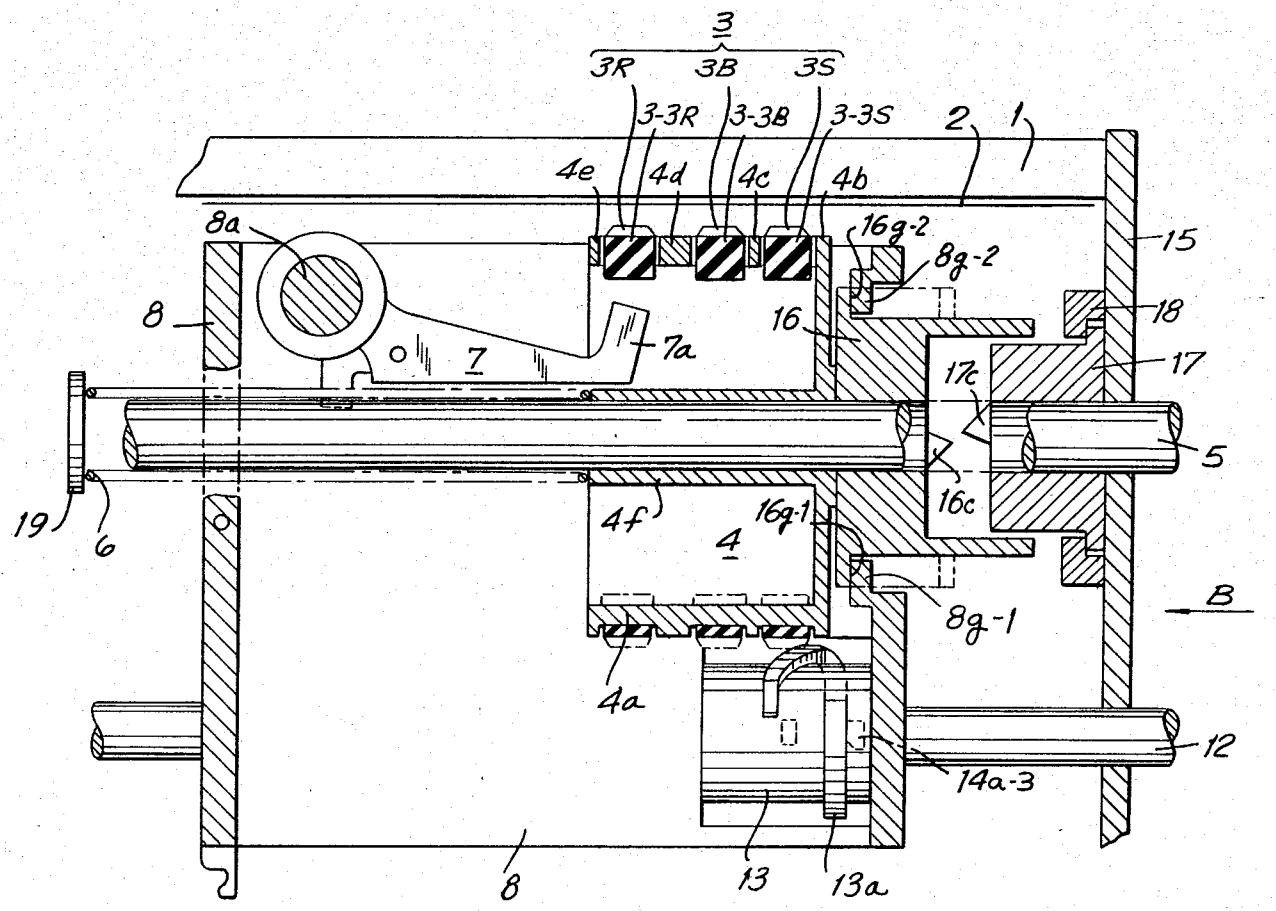

In the position of FIG. 15, the presser 7a is positioned in confronting relationship to the second-color printing type wheel 3-3R. When the first cam 16 is pushed the distance $P_3$-$\delta_3$ in the direction of the arrow B, the teeth 16c, 17c are displaced out of engagement with each other, and the type wheels 3 are freely rotatable even with the first cam 16 prevented from rotation by the portions 8g-1, 8g-2 of the carriage 8. In the fourth character position, a desired character on the type wheel 3-3R can be printed in a second color. The carriage 8, the first cam 16 and the holder 4 can then be shifted in unison to successive character positions on the line, during which time the presser 7a remains facing the type wheel 3-3R. Accordingly, desired characters on the type wheel 3-3R can be printed in the second color up to a desired character position beyond the fourth character position.

From the foregoing description, it will be understood that characters can controllably be selected and printed in the first or second color quite easily in character positions higher than the third or fourth character position.

In the above description, the teeth 16c, 17c, the first stepped surfaces 16f-1, 16f-2 and the second stepped surfaces 16g-1, 16g-2 in the first cam 16, the projections 16f-1a, 16f-2a and the projections 16f-1b, 16f-2b on the first cam 16, are all provided in pairs. However, the components may not necessarily be paired, but only one of each component pair will suffice. The reason for employing paired components is that for the B or R selection in the second character position, a character position signal, selectable by the kind of a character selected in the first character position, can be generated until the type wheels 3 makes a half revolution at most, while when the components are each provided as a single part, not as a pair, the above signal will be generated until the type wheels 3 make one revolution at most. Thus, the paired components allow a single line to be printed in a reduced period of time.

The number of types on a single type wheel may be other than fourteen.

Although in the foregoing embodiment only one symbol type wheel 3-3S has been described, the present invention should not be interpreted as being limited to the use of a single symbol type wheel as the above description can be applied to one symbol type wheel at the highest character position out of two or more symbol type wheels employed with associated numeral type wheels.

With the above arrangements, characters can be printed in the first or second color successively from the lowest character position, and character selection in the second and third character positions differs only slightly in timing for the B selection and the R selection. The serial printer of the invention is capable of printing characters in an approximately equal period of time per line provided the same combination of such characters and the same character positions are involved, and is of high advantage as it can overcome the conventional difficulties.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A serial printer comprising:

print wheels in the form of annular rings supported on a common holder, said print wheels including a plurality of raised type positioned on and spaced around the outer peripheral surface of each said annular ring, said print wheels including at least a first group of printing types and a second group of printing types, each said printing types having a face;

a rotatable shaft supporting said print wheels on said common holder for corotation of said print wheels;

hammer means having a presser for selectively confronting and pressing the types of said print wheels from inside said annular rings to press the face of a selected type on a sheet of recording paper;

a platen, said recording paper being positioned between said platen and said print wheels;

a carriage having mounted thereon said hammer means for laterally shifting said hammer means therewith successively from one print position to the next, said print wheels being mounted on said carriage; and switching means for selectively bringing said presser of said hammer means into confronting relationship to a print wheel of said first group of printing types or alternatively in confronting relationship to a print wheel of said second group of printing types, said confronting relationship being determined during a lateral shifting stroke of said carriage between one printing position and the next printing position, wherein said carriage includes an engaging member fixedly attached thereto, said switch means including:

a first cam for translating said print wheels axially on said shaft, said first cam having a first stepped surface for engaging with said engaging member of said carriage during a lateral shifting stroke of said carriage to position said presser in confronting relationship to a print wheel of said first group of print types, and a second stepped surface for alternatively engaging with said member of said carriage during said lateral shifting stroke of said carriage to position said presser in confronting relationship to a print wheel of said second group of print types;

a second cam engageable with said first cam for rotating said first cam, and means for stopping rotation of said second cam so as to selectively position said engaging member of said carriage into confronting relationship to said first stepped surface or alternatively to said second stepped surface.

2. A serial printer as claimed in claim 1, and further comprising a third cam having a portion engageable with said engaging member of said carriage, said presser being in confronting relationship to a first print wheel when said engageable portion of said third cam engages said engaging member of said carriage,-said third cam including a guide slot for guiding said engaging member to reach and engage with said first stepped surface of aid first cam or alternatively to reach and engage with said second step surface of said first cam, said presser being in confronting relationship to a second print wheel when said engaging member of said carriage engages said first step surface and being in confronting relationship to a third print wheel when said engaging member of said carriage is engaged with said second stepped surface;

trigger means for forcibly rotating said third cam while said carriage is being laterally shifted to a preselected character position, said forcible rotation bringing said engaging member of said carriage from engagement with said engageable portion of said third cam into engagement with said first stepped surface or alternatively said second stepped surface of said first cam.

3. A serial printer as claimed in claim 1, wherein said first group of printing types print in a first color and said second group of printing types print in a second color, said serial printer further comprising inking means for providing the appropriate color ink to the faces of the printing types prior to printing.

4. A serial printer as claimed in claim 1, wherein said first group of printing types print in a first color, and said second group of printing types print in a second color, said serial printer further comprising inking means for providing the appropriate color ink to the faces of the printing types prior to printing.

5. A serial printer as claimed in claim 2, wherein said first group of printing types print in a first color and said second group of printing types print in a second color, said serial printer further comprising inking means for providing the appropriate color ink to the faces of the printing types prior to printing.

6. A serial printer as claimed in claim 5, wherein said first and second print wheels are in the same group of the first color type and said third print wheel has types of said second color.

7. A serial printer as claimed in claim 6, wherein said first and second print wheels each carry different forms of character information in the types.

8. A serial printer as claimed in claim 2, and further comprising means for rotating said rotatable shaft, and means for shifting said carriage, and means for actuating said hammer means to press said types against said recording paper.

9. A serial printer as claimed in claim 2, and further comprising means for preventing rotation of said rotatable shaft when characters on said type wheels are printed and when said carriage is shifted.

10. A serial printer comprising:

a plurality of print wheels of flexible material in the form of annular rings, said print wheels each including plurality of raised type positioned on and spaced around the outer peripheral surfaces of said annular rings;

a platen positioned in opposition to said print wheels and spaced therefrom;

movable support means for holding said print wheels, said support means being of an open structure allowing access to the backside of each said raised type, said support means when moving in a first mode causing each said raised type to move to oppose in sequence said platen;

means for moving said support means in said first mode and for stopping said support means with a selected one of said raised type opposing said platen;

impact means for impacting the accessible backside of said selected one of said raised type, said impact flexing and extending said annular ring and pressing the face of the selected type against said platen;

a carriage mounted for lateral translation relative to said platen with said print wheels, support means and impact means being supported on said carriage and moving therewith, whereby a line of selected type can be printed on said print medium;

indexing means for moving said support means in a second mode, said second mode being translation of said support means with said print wheels in said lateral direction relative to said impact means, said impact means impacting the accessible backside of types on different annular print wheels dependent upon the relative lateral position of said support means; and wherein the number of lateral positions of said support means relative to said impact means is at least two and further comprising means to initiate said lateral translation of said support means relative to said impact means when said carriage laterally translates to a preselected position, and wherein the number of said lateral positions of said support means relative to said impact means is at least three and wherein said means to initiate said latest translation of said support means comprises switching means for selectively bringing said support means from the first lateral position to the second lateral position when said carriage laterally translates to said preselected position, or alternatively to bring said support means to said third lateral position from said first lateral position when said carriage laterally translates to said preselected position, a different print wheel being aligned to said impact means at each lateral position of said support means, and further comprising a shaft, said print wheels being mounted on said shaft for rotation therewith and for axial motion therealong;

said indexing means including:

a first cam for translating said print wheels axially on said shaft, said first cam having a first step surface for engaging a fixed member of said carriage during a lateral shifting stroke of said carriage to said preselected position, said impact means being aligned with the second said lateral position of said support means, and a second step surface for alternatively engaging with said carriage member during lateral shifting of said carriage to said preselected position, said impact means being aligned to the third lateral position on said support means.

11. A serial printer as claimed in claim 10, and further comprising a second cam engageable with said first cam for rotating said first cam;

a third cam having a portion engageable with said fixed member of said carriage, said impact means being in confronting relationship to a first print wheel when said engageable portion of said third cam engages said fixed member of said carriage, said third cam including a guide slot for sliding said fixed carriage member to reach and engage with said first step surface of said first cam or alternatively to reach and engage with said second step surface of said first cam, said impact means being in confronting relationship to a second print wheel when said fixed member of said carriage engages in said first step surface and being in confronting relationship to a third print wheel when said fixed member of said carriage is engaged with said second step surface;

trigger means for forcibly rotating said third cam while said carriage is being laterally shifted to said preselected position, said forcible rotation bringing said fixed member of said carriage from engagement with said engageable portion of said third cam into engagement with said first step surface or alternatively with said second step surface of said first cam.

12. A serial printer as claimed in claim 11, wherein the position of said support means resulting from said first mode of motion determines whether said carriage fixed member engages said first or second stepped surface.

* * * * *